US007663298B2

(12) United States Patent
Chen et al.

(10) Patent No.: US 7,663,298 B2
(45) Date of Patent: Feb. 16, 2010

(54) LIGHT SOURCE APPARATUS USING FIELD EMISSION CATHODE

(75) Inventors: Pi-Jin Chen, Beijing (CN); Peng Liu, Beijing (CN); Lei-Mei Sheng, Beijing (CN); Yang Wei, Beijing (CN); Liang Liu, Beijing (CN); Zhao-Fu Hu, Beijing (CN); Cai-Lin Guo, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 591 days.

(21) Appl. No.: 11/184,662

(22) Filed: Jul. 19, 2005

(65) Prior Publication Data

US 2006/0022574 A1 Feb. 2, 2006

(30) Foreign Application Priority Data

Jul. 30, 2004 (CN) ..... 2004 1 0050974

(51) Int. Cl.
*H01J 1/62* (2006.01)

(52) U.S. Cl. ..... 313/497; 313/310; 313/495; 313/496

(58) Field of Classification Search ..... 313/495–497, 313/310
See application file for complete search history.

(56) References Cited

U.S. PATENT DOCUMENTS 5,589,731 A * 12/1996 Fahlen et al. ..... 313/495
5,600,200 A * 2/1997 Kumar et al. ..... 313/346 R
5,764,004 A 6/1998 Rabinowitz
5,789,857 A * 8/1998 Yamaura et al. ..... 313/495
6,008,575 A 12/1999 Kaftanov et al.
6,031,328 A 2/2000 Nakamoto
6,426,590 B1 7/2002 Chung et al.
6,661,445 B2 * 12/2003 Mashimo et al. ..... 347/238
6,737,798 B2 * 5/2004 Ha ..... 313/495
6,873,095 B1 3/2005 Kjellman
2001/0008361 A1 * 7/2001 Ogawa et al. ..... 313/492
2002/0070648 A1 6/2002 Forsberg
2003/0102799 A1 * 6/2003 Yonezawa et al. ..... 313/495

(Continued)

FOREIGN PATENT DOCUMENTS

CN 1375730 A 10/2002

(Continued)

*Primary Examiner*—Bumsuk Won
(74) *Attorney, Agent, or Firm*—D. Austin Bonderer

(57) ABSTRACT

A light source apparatus (8) includes a rear plate (80), a front plate (89) formed with an anode layer (82), and a cathode (81) interposed therebetween. The cathode includes a plurality of electrically conductive carriers (812) and a plurality of field emitters (816) formed thereon. The field emitters are uniformly distributed on anode-facing surfaces of the conductive carriers. The anode layer includes a plurality of curving portions (820) corresponding to the conductive carriers. Preferably, the field emitters extend radially outwardly from the corresponding conductive carriers. The conductive carriers are parallel with each other, and are located substantially on a common plane. Each of the conductive carriers can be connected with a pulling device arranged at least one end thereof, and an example of the pulling device is a spring. The conductive carriers may be cylindrical, prism-shaped or polyhedral.

19 Claims, 4 Drawing Sheets

8

U.S. PATENT DOCUMENTS

| | | | | |
|---|---|---|---|---|
| 2005/0174038 | A1* | 8/2005 | Lee et al. | 313/495 |
| 2005/0174059 | A1 | 8/2005 | Obratzsov | |
| 2006/0066214 | A1 | 3/2006 | Chen et al. | |
| 2007/0152564 | A1 | 7/2007 | Lin | |

FOREIGN PATENT DOCUMENTS

| | | | |
|---|---|---|---|
| CN | 1474214 | A | 2/2004 |
| CN | 1504803 | A | 6/2004 |
| WO | WO03088308 | A1 | 10/2003 |

* cited by examiner

LIGHT SOURCE APPARATUS USING FIELD EMISSION CATHODE

CROSS-REFERENCE TO RELATED APPLICATION

This application is related to a copending U.S. utility patent application entitled "FIELD EMISSION CATHODE AND LIGHT SOURCE APPARATUS USING SAME", filed on Jul. 14, 2005 with application Ser. No. 11/181,552, and having the same assignees thereof, which is entirely incorporated herein by reference.

FIELD OF THE INVENTION

The present invention relates to light source apparatuses, and more particularly to a light source apparatus having a field emission cathode.

BACKGROUND

Fluorescent lamps are very popular light sources. A fluorescent lamp is a gas discharge tube. Generally, an inner surface of the wall of the tube is coated with light-emitting materials. Such light-emitting materials are usually fluorescent or phosphorescent metallic salts. The tube is filled with mercury vapor at extremely low pressure, and filaments are provided at each end of the tube. The light of the fluorescent lamp is not produced by an incandescent body (such as the filament of an ordinary electric lamp), but is emitted as a result of the excitation of atoms (namely, those of the mercury vapor and the fluorescent coating). Detailedly, electrons ejected from the cathode filaments collide with the mercury atoms of the vapor, and cause the mercury atoms to emit radiation. The radiation is mostly ultraviolet rays, which are invisible. The ultraviolet light strikes the fluorescent materials on the inner surface of the wall of the tube. Typically, this causes the fluorescent materials to emit radiation with a longer wavelength in the visible range of the spectrum. In this way, the coating transform the invisible ultraviolet rays into visible light.

A fluorescent lamp has certain advantages. Most notably, operation of the fluorescent lamp is highly economical compared to other light sources such as electric lamps. However, the fluorescent lamp also has certain drawbacks. For example, ultraviolet light needs to be transformed into visible light. Thus a certain amount of loss of light energy is inevitable. Further, there is a delay between powering on of the fluorescent lamp and the time when it begins to provide steady illumination. Additionally, relatively complicated control equipment is needed, which requires extra space. Moreover, some materials used in the fluorescent lamp, particularly mercury vapor, are liable to pollute the environment.

What is needed, therefore, is a clean light source with high light emission efficiency.

SUMMARY

A light source apparatus provided herein generally includes a field emission cathode and a first anode facing toward the field emission cathode. The field emission cathode includes a plurality of electrically conductive carriers and a plurality of field emitters formed thereon. The first anode includes a plurality of curved portions corresponding to the conductive carriers.

In one exemplary embodiment, the light source apparatus further includes a second anode, and wherein the field emission cathode is arranged between the first and second anodes. The second anode preferably includes a plurality of curved portions corresponding to the conductive carriers.

Preferably, the light source apparatus may further include a grid electrode arranged between the first anode and the field emission cathode. The conductive carriers are parallel with each other, and are located substantially on a common plane. The field emitters may extend radially outwardly from the corresponding conductive carriers. Each of the conductive carriers can be connected with a pulling device arranged at least one end thereof, and an example of the pulling device is a spring. The conductive carriers may be cylindrical, prism-shaped or polyhedral. Each of the conductive carriers may be located substantially on a core of a corresponding curved portion thereof.

A material of the field emitters may be selected from metals, non-metals, compositions, and one-dimension nanomaterials.

These and other features, aspects and advantages will become more apparent from the following detailed description and claims, and the accompanying drawings.

DETAILED DESCRIPTION OF THE PREFERRED EMBODIMENTS

Figure 1:
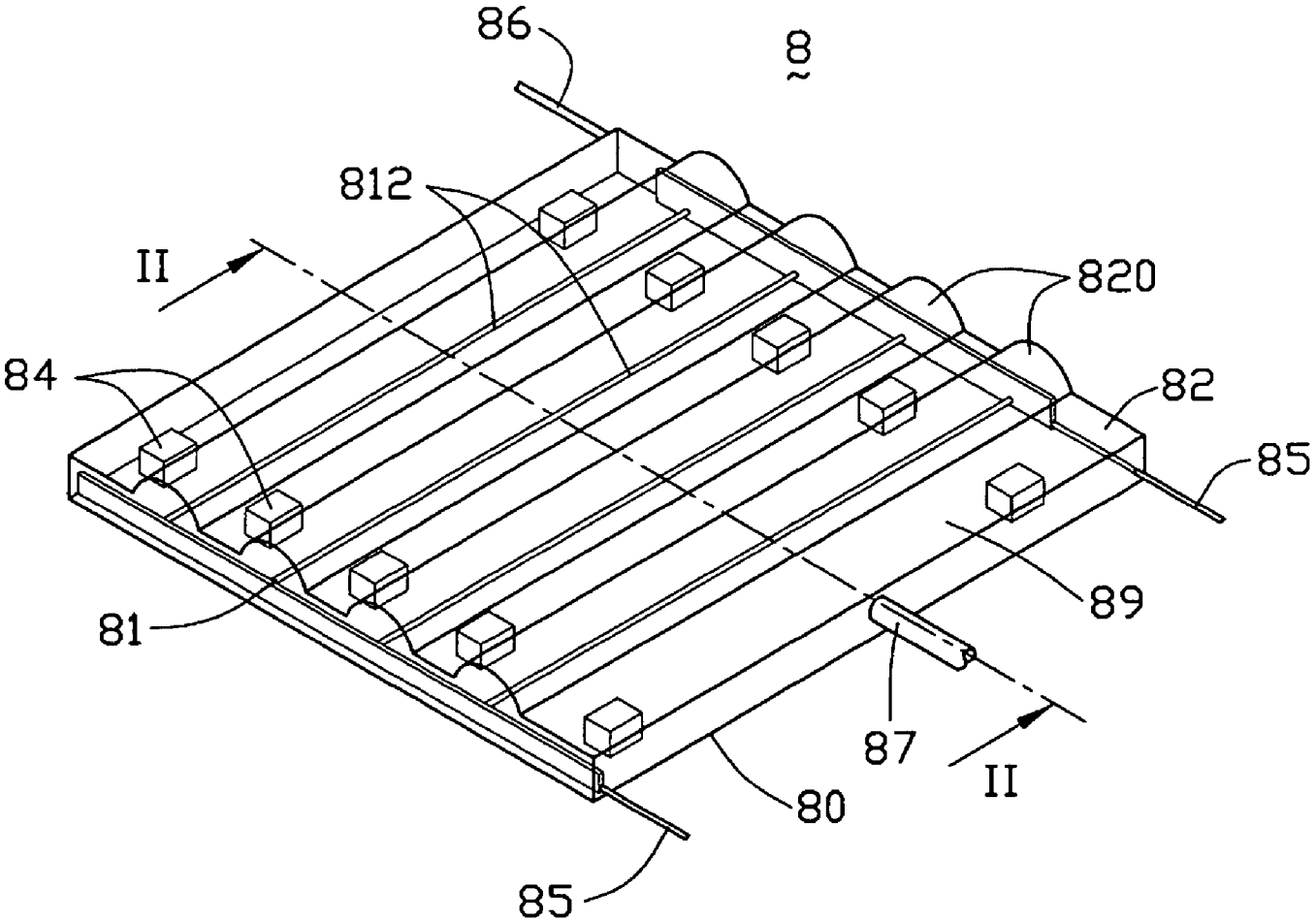
FIG. 1 is a schematic, simplified, isometric view of a light source apparatus in accordance with a first embodiment of the present invention.
Figure 2:
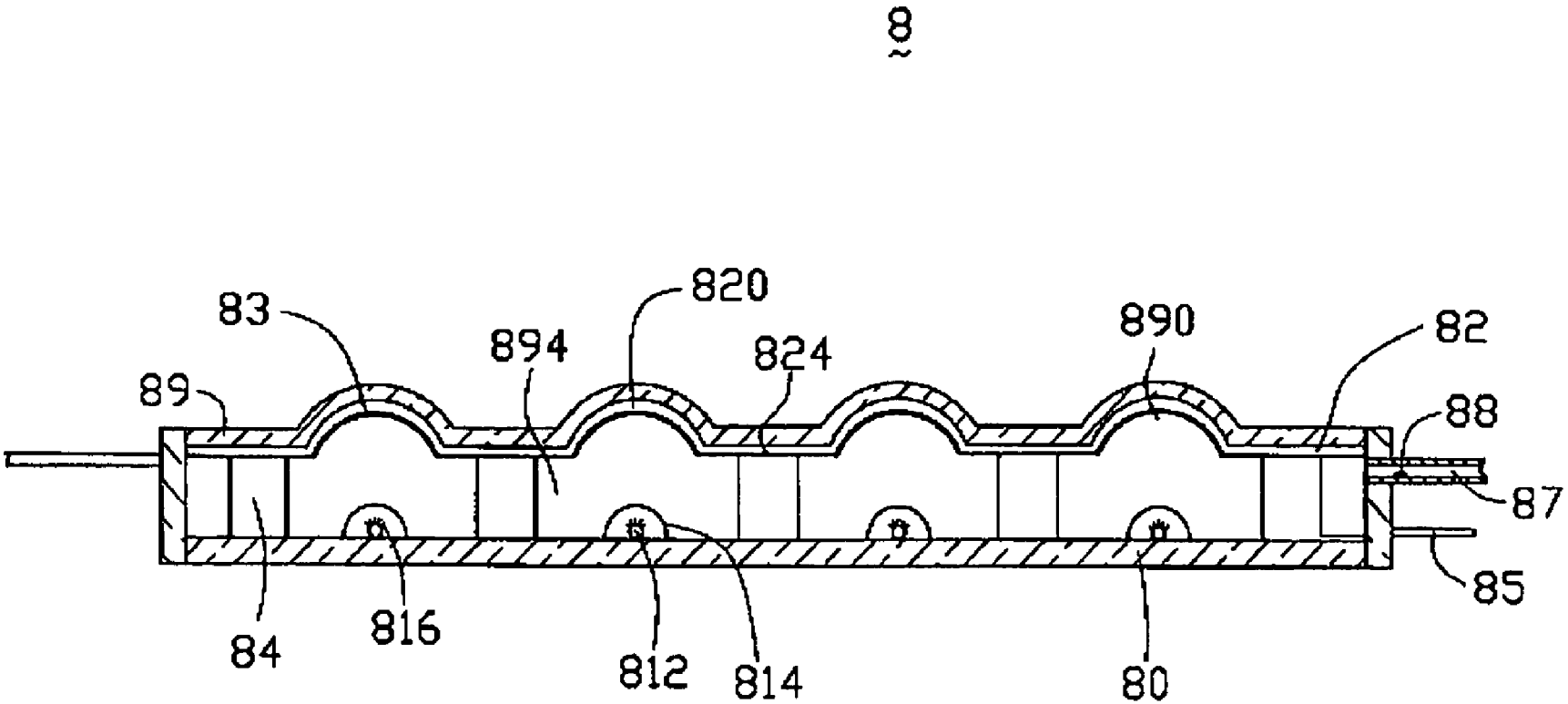
FIG. 2 is a cross-sectional view of the light source apparatus shown in FIG. 1, taken along line II-II thereof.

Referring to FIGS. 1 and 2, a light source apparatus 8 according to a first embodiment of the present invention is shown. The light source apparatus 8 has one lighting surface. As a general overview, the light source apparatus 8 includes a rear plate 80, a front plate 89 formed with an anode layer 82, and a cathode 81 interposed therebetween. The front plate 89 and the rear plate 80 are flat and parallel with each other. Four sides of the light source apparatus 8 are sealed by glass plates. A plurality of transparent supporting poles 84 which are made of glass are located between the front plate 89 and the rear plate 80, for strengthening the structure of the light source apparatus 8. An inner space of the light source apparatus 8 is substantially a vacuum.

The cathode 81 includes a plurality of electrically conductive carriers 812, and a plurality of field emitters 816 formed thereon. The field emitters 816 are uniformly distributed on anode-facing surfaces of the conductive carriers 812. Preferably, the field emitters 816 extend radially outwardly from the corresponding conductive carriers 812. Consequently, any shielding effect between adjacent field emitters 816 is minimized. Accordingly, an electron-emitting effect of the cathode 81 is increased, and an overall performance of the light source apparatus 8 is improved. In the illustrated embodiment, the carriers 812 are cylindrical, and are parallel with each other. Intervals between two neighboring carriers 812 are uniform. As a result, the field emitters 816 formed on the carriers 812 cooperatively constitute a field emission array. Preferably, the carriers 812 are identical in shape and size, and central axes thereof are arranged substantially in a same common plane. That is, the cathode 81 can provide a flat field emission array. Thereby, a substantially planar light source is achieved, and additional corrective optical components can be omitted.

The cathode 81 is secured by two holding sheets (not labeled), which are located on the rear plate 80 and abut two sides of the light source apparatus 8 respectively. Two cathode down-leads 85 are arranged on two sides of the cathode 81, for providing electrical connections with each of the carriers 812.

In the illustrated embodiment, the carriers 812 are conductive filaments. The field emitters 816 are formed on the carriers 812 by electrophoresis, chemical vapor deposition (CVD), or another suitable method. The carriers 812 formed with the field emitters 816 are secured on the holding sheets, with uniform spaces between the carriers 812. The cathode 81 is thereby formed. Alternatively, the carriers 812 can be secured on the holding sheets before the field emitters 816 are deposited on the carriers 812.

The field emitters 816 have micro-tips, which may for example be tungsten micro-tips, zinc oxide micro-tips, or diamond micro-tips. In general, a material of the field emitters 816 is selected from metals, non-metals, compositions, and one-dimensional nanomaterials. The compositions include zinc oxide and other materials known in the art. The one-dimensional nanomaterials may include nanotubes, nanowires, or the like; for example, carbon nanotubes, silicon nanowires, or molybdenum nanowires.

The front plate 89 is generally made of plate. A plurality of grooves 890 are formed on the front plate 89, with openings of the grooves 890 facing toward the caters 812 respectively. In this embodiment, cross-sectional shapes defined by the grooves 890 are arcuate. In other examples, the groove 890 may define a first receiving area with cross section that is V-shaped, semicircular, or polygonal. It is preferable that each of the carriers 812 is located directly opposite a center of a corresponding groove 890, for obtaining a better emission effect. The anode layer 82 is a transparent conductive layer formed on a cathode-facing surface of the front plate 89. This can be obtained by depositing indium-tin oxide on the cathode-facing surface. The anode layer 82 includes a plurality of curved portions 820 formed on inner surfaces of the front plate 89 in the grooves 890 and a plurality of flat portions 824 connected the curved portions 820. Accordingly, the curved portions 820 face toward the carriers 812 respectively. Each two adjacent supporting poles 84, the flat portion 824 and the rear plate 80 cooperatively define a second receiving area 894. The conductive carriers 812 can be located in the second receiving area 894 and not in the first receiving area.

Fluorescent layers 83 are formed on the curved portions 820 of the anode layer 82, corresponding to each of the carriers 812. The fluorescent layers 83 contain red, green, and yellow fluorescent materials. Alternatively, the fluorescent layers 83 contain white fluorescent materials. Additionally, the anode layer 82 can be formed in parallel strips corresponding to the fluorescent layers 83, or the fluorescent layers 83 can be formed like a plate on the anode layer 82. An anode down-lead 86 is arranged on one side of the anode layer 82, for providing current to the anode layer 82.

It is noted that a substantially planar light source can be achieved if the grooves 890 are sufficiently small, and if a density of the grooves 890 is sufficiently large. Moreover, a particular brightness of the light source apparatus 8 is a function of many factors, such as a voltage and current density of the anode layer 82, and an emitting effect of the fluorescent materials. Such factors can be configured according to need in order to obtain a desired brightness.

One side wall of the light source apparatus 8 defines a vent hole (not labeled), and a vent pipe 87 is engageably received in the vent hole. The vent pipe 87 has a getter 88 on an inner wall thereof, for maintaining a high vacuum of the light source apparatus 8.

Alternatively, if desired, a grid electrode 814 can be arranged between the anode layer 82 and the cathode 81, for extracting electrons from the field emitters 816. For example, the grid electrode 814 can be a metallic net patterned by lithography. Generally, an electron-emitting effect of the field emitters 816 can be increased accordingly.

The light source apparatus 8 has many advantages shared by field emission devices in general. Field emission devices are based on emission of electrons in a vacuum in order to produce visible light. Electrons are emitted from micron-sized tips in a strong electric field, and the electrons are accelerated and collide with a fluorescent material. The fluorescent material then emits visible light. The loss of light energy of a field emission device is markedly lower than that of a conventional fluorescent lamp, therefore a field emission device can provide high brightness. In addition, a light source using a field emission cathode is thin and light. Furthermore, a field emission device does not use any materials that can harm the environment.

Figure 3:
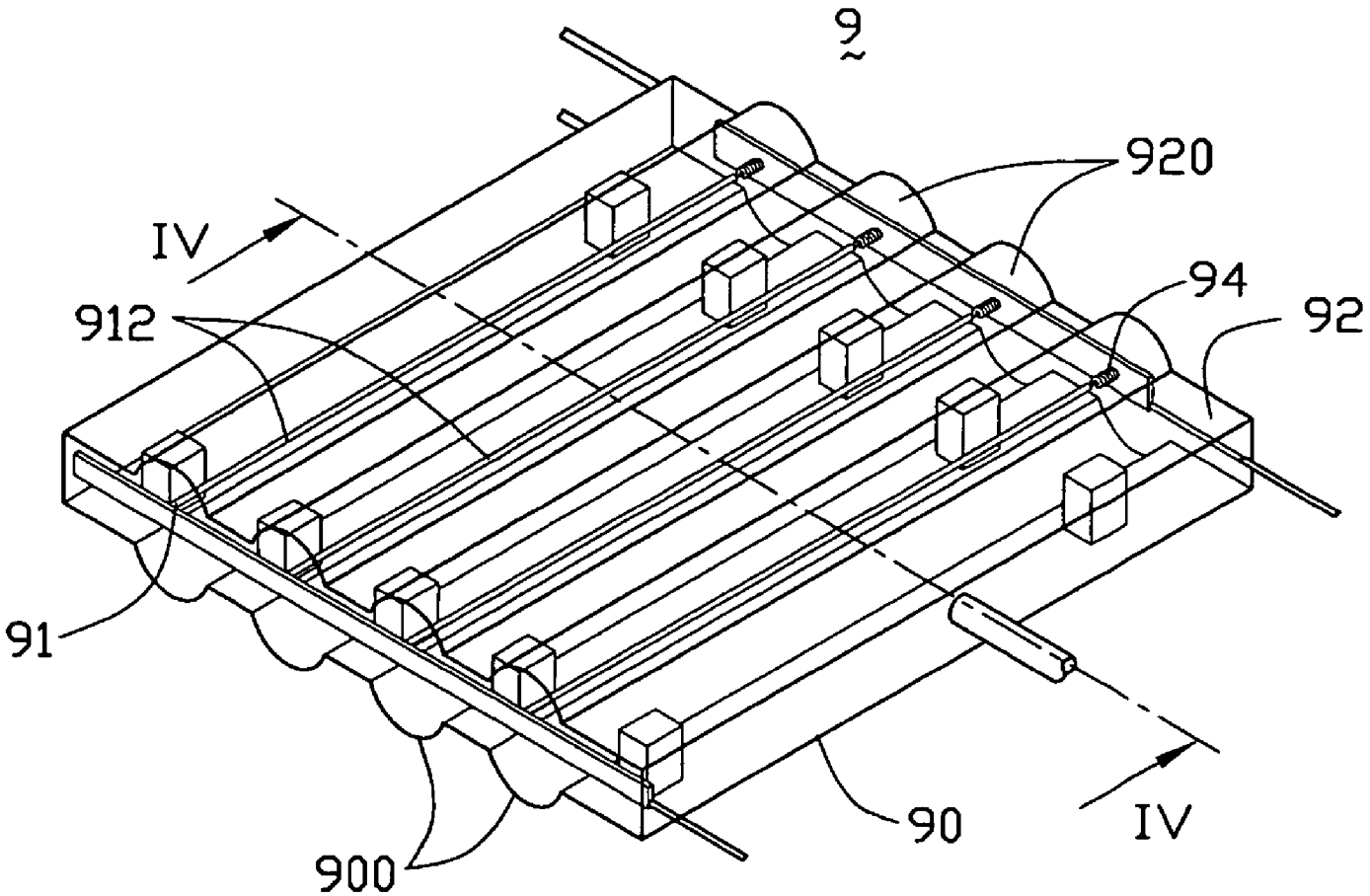
FIG. 3 is a schematic, simplified, isometric view of a light source apparatus in accordance with a second embodiment of the present invention.
Figure 4:
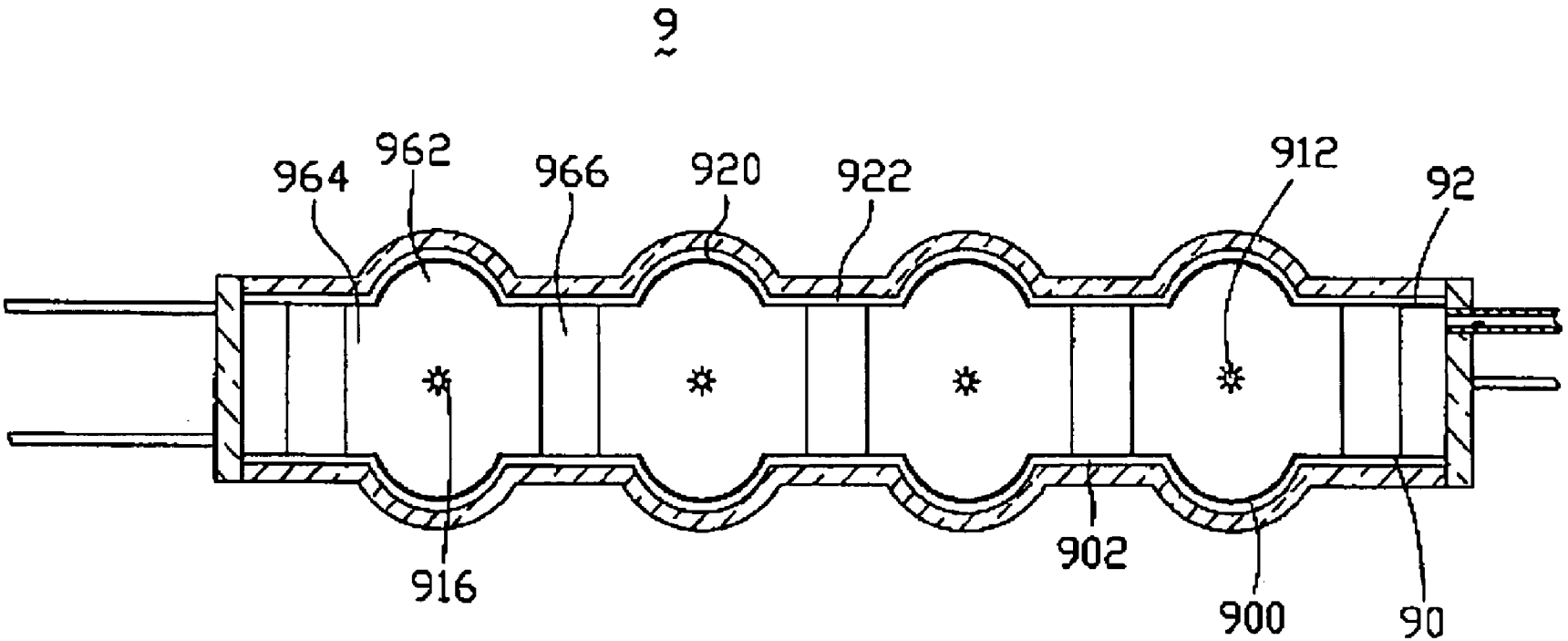
FIG. 4 is a cross-sectional view of the light source apparatus shown in FIG. 3, taken along line IV-IV thereof.

Referring to FIGS. 3 and 4, a light source apparatus 9 according to a second embodiment of the present invention is shown. The light source apparatus 9 has two lighting surfaces. The main difference between the two light source apparatuses 8 and 9 is that in the second embodiment, the light source apparatus 9 includes two anode layers 90, 92, and a cathode 91 located therebetween. Further, the cathode 91 includes a plurality of conductive carriers 912, and a plurality of field emitters 916 formed on both sides of each of the carriers 912 facing toward the two anode layers 90, 92. The anode layer 90 includes a plurality of curved portions 900 and a plurality of flat portions 902 connected the curved portions 900. The anode layer 92 includes a plurality of curved portions 920 and a plurality of flat portions 922 connected the curved portions 920. The curved portions 900, 920 face toward each other. A plurality of supporting poles 966 is located between the flat portions 922, 902 of the two anode layers 90, 92, each inner surface of each curved portion 920, 900 defines a first receiving area 962. Each two adjacent supporting poles 966, the flat portion of the anode layer 90 and the corresponding flat portion of the anode layer 92 cooperatively define a second receiving area 964. The conductive carriers 912 are located in the second receiving area 964 and not in the first receiving area 962. Each of the carriers 912 is located directly opposite a center of the corresponding curved portion 900 and a center of the corresponding curved portion 920. If desired, one of the two anodes 90, 92 can be formed as a flat plate with no curved portions.

Additionally, in the second embodiment, each of the carriers 912 has one end secured on a holding sheet by a spring 94. The spring 94 pulls the carrier 912 and keeps it straight. More particularly, the spring 94 has one flexible end connected with the end of the corresponding carrier 912, and another end fixed on the holding sheet. Accordingly, the carriers 912 are accurately maintained in a common plane. This helps ensure that electron emission is relatively uniform. In addition, the cathode 91 is more stable, and the useful working lifetime of the whole light source apparatus 9 can be increased. Alternatively, each of the carriers 912 can have its both ends connected with springs 94, for providing a better pulling effect.

It should be noted that the carriers may have other shapes suitably adapted for practicing the present invention. For example, the carriers may be prism-shaped or polyhedral. Furthermore, other pulling devices such as filaments can be employed to keep the carriers straight. Moreover, it will be apparent to those skilled in the art that some factors, for example, the number of the carriers, the means for holding the carriers, and the arrangement of down-leads of the electrodes, can be changed according to particular need. In summary, the particular light source apparatuses described above are not critical to practicing the present invention.

It should be further noted that the light source apparatuses 8, 9 can be used in a variety of applications requiring illumination, particularly where a planar light source is required.

Finally, while the present invention has been described with reference to particular embodiments, the description is intended to be illustrative of the invention and is not to be construed as limiting the invention. Therefore, various modifications can be made to the embodiments by those skilled in the art without departing from the true spirit and scope of the invention as defined by the appended claims.

We claim:

1. A light source apparatus comprising:

a rear plate;

a front plate comprising a plurality of concave curved portions and a plurality of flat portions, wherein the plurality of flat portions are parallel to the rear plate; a plurality of supporting poles, each supporting pole is located between one flat portion and the rear plate; an inner surface of each curved portion defines a first receiving area; each two adjacent supporting poles, the corresponding flat portions, and the rear plate cooperatively define a second receiving area;

a field emission cathode located between the rear plate and the front plate, and comprising a plurality of electrically conductive carriers and a plurality of field emitters located on the conductive carriers; wherein the conductive carriers are located in the second receiving areas and not in the first receiving areas; and a first anode located on the front plate and facing toward the field emission cathode, the first anode comprising a plurality of concave curved portions corresponding to the plurality of concaved curved portions of the front plate and a plurality of flat portions corresponding to the plurality of flat portions of the front plate.

2. The light source apparatus according to claim 1, further comprising a grid electrode arranged between the first anode and the field emission cathode.

3. The light source apparatus according to claim 1, further comprising a second anode located on the rear plate, the rear plate comprising a plurality of rear plate concave curved portions and a plurality of rear plate flat portions, and wherein the field emission cathode is arranged between the first and second anodes.

4. The light source apparatus according to claim 3, wherein the second anode includes a plurality of second anode curved portions corresponding to the conductive carriers and a plurality of second anode flat portions connected the curved portions.

5. The light source apparatus according to claim 4, wherein the plurality of the emitters located on both sides of each of the carriers face toward the first anode and the second anode, and the plurality of concave curved portions of the first anode and the plurality of second anode curved portions face each other.

6. The light source apparatus according to claim 1, wherein the conductive carriers are parallel with each other, and are located substantially in a common plane.

7. The light source apparatus according to claim 1, wherein the field emitters extend radially outwardly from the corresponding conductive carriers.

8. The light source apparatus according to claim 1, wherein a material of the field emitters is selected from the group consisting of metals, non-metals, compositions, and one-dimensional nanomaterials.

9. The light source apparatus according to claim 1, wherein at least one end of each of the conductive carriers is connected with a pulling device.

10. The light source apparatus according to claim 9, wherein the pulling device is a spring.

11. The light source apparatus according to claim 1, wherein the conductive carriers are cylindrical, prism-shaped, or polyhedral.

12. The light source apparatus according to claim 1, wherein each of the conductive carriers is located substantially on a core of the corresponding curved portion.

13. The light source apparatus according to claim 1, wherein cross-sectional shapes of the plurality of concave curved portions of the first anode are arcuate, V-shaped, semicircular, or polygonal.

14. The light source apparatus according to claim 1, wherein fluorescent layers are located on the plurality of concave curved portions of the first anode corresponding to each of the carriers.

15. The light source apparatus according to claim 1, wherein each two adjacent transparent supporting poles together with the rear plate and the front plate define a unit of the light source.

16. The light source apparatus according to claim 1, wherein the field emitters have micro-tips.

17. A light source apparatus comprising:

two lighting surfaces of said apparatus for being light-viewable outside said apparatus through said two lighting surfaces;

an electrifiable cathode located in said apparatus next to said two lighting surfaces and comprising a plurality of field emitters located thereon and electrically connected therewith, each of said plurality of field emitters substantially pointing to said two lighting surfaces and electrifiable with said cathode to emit electrons;

two anode layers located between said cathode and said two lighting surfaces and spaced from said cathode to be electrifiable to accept said electrons from said plurality of field emitters for light emission of said apparatus, each of said two anode layers comprising a plurality of curved portions corresponding to the field emitters and a plurality of flat portions connected to adjacent two ends of the curved portions, a plurality of supporting poles, each supporting pole being located between two corresponding flat portions of the two anode layers, each inner surface of each curved portion defining a first receiving area; wherein each two adjacent supporting poles, the flat portion of one of the anode layers and the corresponding flat portion of the other anode layer cooperatively define a second receiving area, the field emitters are located in the second receiving area.

18. The light source apparatus according to claim 17, wherein said cathode includes a plurality of electrically conductive carriers, and said plurality of field emitters are located on each of said plurality of carriers.

19. A light source apparatus comprising:

at least one lighting surface of said apparatus for being light-viewable outside said apparatus through said at least one lighting surface;

an electrifiable cathode located in said apparatus beside said at least one lighting surface, said cathode comprising a plurality of electrically conductive carriers, and each of said plurality of carriers having a plurality of field emitters located thereon and electrically connected therewith to be electrifiable for emitting electrons;

a rear plate;

a front plate comprising a plurality of curved portions and a plurality of flat portions, wherein the plurality of flat portions are parallel to the rear plate, a plurality of supporting poles, each supporting pole is located between one flat portion and the rear plate, an inner surface of each curved portion defines a first receiving area, each two adjacent supporting poles, the corresponding flat portions and the rear plate cooperatively define a second receiving area, the conductive carriers are located in the second receiving areas; and an anode layer located on the front plate and between said lighting surface and said cathode and spaced from said cathode, said anode layer comprising a plurality of anode curved portions corresponding to the plurality of curved portions of the front plate and substantially surrounding emitter-located parts of said each of said plurality of carriers, and a plurality of anode flat portions corresponding to the plurality of flat portions of the front plate and connected to adjacent two ends of the anode curved portions.

* * * * *

UNITED STATES PATENT AND TRADEMARK OFFICE

CERTIFICATE OF CORRECTION

PATENT NO. : 7,663,298 B2
APPLICATION NO. : 11/184662
DATED : February 16, 2010
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 743 days.

Signed and Sealed this

Thirtieth Day of November, 2010

David J. Kappos

David J. Kappos
*Director of the United States Patent and Trademark Office*